US007455396B2

(12) United States Patent
Wakayama

(10) Patent No.: US 7,455,396 B2
(45) Date of Patent: Nov. 25, 2008

(54) INK CONTAINER

(76) Inventor: Takahiro Wakayama, c/o Riso Kagaku Corporation, 20-15, Shinbashi 2-chome, Minato-ku, Tokyo (JP) 1050004

( * ) Notice: Subject to any disclaimer, the term of this patent is extended or adjusted under 35 U.S.C. 154(b) by 32 days.

(21) Appl. No.: 10/595,331

(22) PCT Filed: Jul. 8, 2004

(86) PCT No.: PCT/JP2004/009745

§ 371 (c)(1),
(2), (4) Date: Apr. 10, 2006

(87) PCT Pub. No.: WO2005/037560

PCT Pub. Date: Apr. 28, 2005

(65) Prior Publication Data

US 2007/0046743 A1 Mar. 1, 2007

(30) Foreign Application Priority Data

Oct. 16, 2003 (JP) ..... 2003-356333

(51) Int. Cl.
*B41J 2/175* (2006.01)

(52) U.S. Cl. ..... 347/86; 222/464.1; 222/464.3; 222/386.5; 347/88; 493/212; 96/6

(58) Field of Classification Search ..... None
See application file for complete search history.

(56) References Cited

U.S. PATENT DOCUMENTS 5,566,851 A * 10/1996 Sasaki et al. ..... 229/117.27
5,724,082 A * 3/1998 Moynihan ..... 347/88

(Continued)

FOREIGN PATENT DOCUMENTS

JP 4-214361 8/1992

(Continued)

OTHER PUBLICATIONS

International Search Report for PCT/JP2004/009745 dated Aug. 10, 2004.

*Primary Examiner*—Matthew Luu
*Assistant Examiner*—John P Zimmermann
(74) *Attorney, Agent, or Firm*—Christa Hildebrand; Norris, McLaughlin & Marcus

(57) ABSTRACT

Provided is an ink container suitable for forming a stable high-quality print image and obtaining stable operation of a printing device by enabling precipitates of coarse-grained ink etc. standing in an ink container body to be left in the ink container body and by eliminating troubles due to the supply of such precipitates of coarse-grained ink etc. to the printing device. A region for residual ink liquid 4 and a sheet-entry preventing member 6 as shape retaining means 5 are provided on the bottom 2*a* side of a bag-like ink container body 2 formed from a flexible sheet. The region for residual ink liquid 4 is disposed in a position lower than one end 3*a* of an ink supply opening part 3 fixed to the ink container body 2. When the sheet composing the ink container body 2 moves, the sheet-entry preventing member 6 prevents the sheet from entering the region for residual ink liquid 4, thereby keeping the shape and volume of the region part for residual ink liquid 4.

7 Claims, 3 Drawing Sheets

U.S. PATENT DOCUMENTS

| | | | | |
|---|---|---|---|---|
| 6,511,168 | B2 * | 1/2003 | Higuma | 347/86 |
| 6,830,323 | B2 * | 12/2004 | Perkins et al. | 347/86 |
| 6,832,830 | B2 * | 12/2004 | Seino et al. | 347/86 |
| 6,848,775 | B2 * | 2/2005 | Ishizawa et al. | 347/86 |
| 2004/0237343 | A1 * | 12/2004 | Herman | 36/28 |

FOREIGN PATENT DOCUMENTS

| | | |
|---|---|---|
| JP | 06-211273 | 8/1994 |
| JP | 09-150500 | 6/1997 |
| JP | 11-165747 | 6/1999 |
| JP | 2001-199455 | 7/2001 |
| JP | 2002-002789 A | 1/2002 |

* cited by examiner

INK CONTAINER

TECHNICAL FIELD

The present invention relates to an ink container which is used by being mounted on a printing device and, more particularly, to an ink container which enables precipitates of coarse-grained ink etc. standing in an ink container body to be positively left in the ink container body.

BACKGROUND ART

In a case where ink is stored for a long period of time in an ink container, in a case where due to the low frequency of use of a printing device, the ink in the ink container mounted on the printing device is not consumed for a long period of time, and in other cases, the ink used in the printing device may sometimes change with time in the ink container.

For example, (a) in the case of pigment ink, coarse-grained ink is generated due to the condensation of a pigment, and this coarse-grained ink precipitates in the ink container. (b) Also, there is a case where foreign matter which has mixed during the manufacturing of ink precipitates in the ink container. (c) Furthermore, there is also a case where in some combinations of ink and the material for the ink container, added components of the material precipitate are deposited and precipitate in the ink container.

This kind of ink containers which store the ink used in a printing device, are disclosed, for example, in Japanese Patent Laid-Open No. 4-214361, Japanese Patent Laid-Open No. 2001-199455 and Japanese Patent Laid-Open No. 6-211273.

An ink container described in Japanese Patent Laid-Open No. 4-214361 is provided with an ink bag formed from a flexible film etc. as an ink container body which stores ink, and its construction is such that this ink bag is supported by being sandwiched between a top plate and a bottom plate. However, this ink bag is of such a simple construction that the ink bag contracts and is deformed as ink is consumed and the top and bottom plates of the ink bag only suppress the dancing of the ink bag. Therefore, precipitates of coarse-grained ink etc. standing on the bottom of the ink bag flow out of the ink bag due to the contraction and deformation and are supplied to the printing device, and it is difficult to make coarse-grained ink etc. remain in the ink bag.

An ink container described in Japanese Patent Laid-Open No. 2001-199455 is provided with an ink bag body formed from a flexible film etc., and its construction is such that a supporting member is provided in this ink container body. However, this supporting member only reinforces the ink container body and only prevents the deformation of the ink container body which might be caused by taking the content (ink) out of the ink container body. The supporting member does not adopt such a construction that an arbitrary amount of coarse-grained ink etc. is intentionally left in the ink container body.

An ink container described in Japanese Patent Laid-Open No. 6-211273 has an inner bag formed from a flexible film etc. as an ink container body which stores ink, and its construction is such that the outer surface of this inner bag is stuck to the inner surface of an outer box formed from carton. However, the outer box only constrains part of the inner bag. Like the supporting member of Japanese Patent Laid-Open No. 2001-199455 above, also this outer box does not adopt such a construction that an arbitrary amount of coarse-grained ink etc. is intentionally left in the ink container body.

If precipitates of coarse-grained ink etc. as described above flow out of the ink container to the printing device and supplied to the device, the following troubles occur.

In a case where the printing device is an IJ printer ("IJ" means ink jet; IJ will be hereinafter used as ink jet), during the passage of coarse-grained ink through fine pores of an IJ head, the coarse-grained ink impedes the formation of an ink meniscus in the IJ head and appropriate ink discharge is impossible. In some cases, the pores of the IJ head become clogged with the coarse-grained ink, thereby causing the trouble that an appropriate print image cannot be obtained. In the worst case, fine pores of the IJ printer become clogged with the coarse-grained ink and the IJ printer itself does not work normally and is brought into an unusable condition.

In a case where the printing device is a stencil printing device, when coarse-grained ink passes through pores of an ink-passing body of a printing cylinder, such as a plate cylinder and a screen, the pores are clogged with the coarse-grained ink, thereby causing the trouble that an appropriate print image cannot be obtained. In the worst case, fine pores of the stencil printing device become clogged with the coarse-grained ink and the stencil printing device itself does not work normally and is brought into an unusable condition. This applies also to a screen printer, a stamp containing ink in a fine porous section, etc.

Patent Document 1: Japanese Patent Laid-Open No. 4-214361

Patent Document 2: Japanese Patent Laid-Open No. 2001-199455

Patent Document 3: Japanese Patent Laid-Open No. 6-211273

DISCLOSURE OF THE INVENTION

The present invention has been made to solve the above-described problems and has as its object the provision of an ink container suitable for forming a stable high-quality print image and obtaining stable operation of a printing device by enabling precipitates of coarse-grained ink etc. standing in an ink container body to be left in the ink container body and by eliminating troubles due to the supply of such precipitates of coarse-grained ink etc. to the printing device.

To achieve the above-described object, the present invention provides an ink container which is mounted on a printing device. This ink container comprises a bag-like ink container body formed from a flexible sheet, and an ink supply opening, one end of which communicates with the inside of the ink container body and the other end is connected to the printing device, and the ink container body is provided with a region for residual ink liquid, the region being disposed at the bottom, lower than the communicating end of the ink supply opening, and with shape retaining means for keeping the shape and volume of the region for residual ink liquid.

The region for residual ink liquid may consist of a part of the bottom portion of the ink container body and is disposed below and on the border of the ink supply opening.

The region for residual ink liquid can be disposed in such a manner that a top surface thereof coincides with the lowest point of the communicating end of the ink supply opening.

The shape retaining means may keep the shape and volume of the region for residual ink liquid by preventing the sheet of the ink container body from entering into the region for residual ink liquid when the sheet moves.

The shape retaining means may be fixed to either or both of the ink container body and the ink supply opening.

It may be adopted that the shape retaining means is a sheet-entry preventing member having an orifice pore or a plurality of orifice pores on the top surface thereof, the pore being allowable of coarse-grained ink through-passing.

The word "orifice pore" means pore which has wider opening at the top surface of the sheet-entry preventing member for easy sinking through down of coarse-grained ink into the shape retaining means and narrower opening at the back surface (or narrower middle portion of the pore) for preventing returning upward of the coarse-grained ink from the shape retaining means.

In the present invention, the following advantages are obtained from a structure of an ink container having, on the bottom side of the inside, a region for residual ink liquid which shape and volume are kept by shape retaining means.

(1) In spite of ink container body contraction which will be caused by ink flow out through the ink supply opening, the shape and volume of the region for residual ink liquid are kept on and do not suffer any change under protection of shape retaining means. The no change of the region shape and volume ensures coarse-grained ink etc. stably to stay in the region for residual ink liquid and flowing out of coarse-grain ink etc. from the ink container body into a printing device decreases greatly.

(2) Because of the great decrease of the flowing out of coarse-grain ink etc. into the printing device, such clogging in the printing device, such as nozzle clogging of IJ heads in the printing device, pore clogging on a plate cylinder or a plate screen in the printing device, are almost prevented, and forming a stable high-quality print image and stable operation of the printing device may be obtained.

BEST MODE FOR CARRING OUT THE INVENTION

Hereinafter, the best mode for carrying out the invention will be described in detail with reference to the accompanying drawings.

An ink container 1 shown in FIG. 1 is provided with a bag-like ink container body 2, and this bag-like ink container body 2 is formed from a sheet which itself has flexibility. Ink which is used by a printing device, which is not shown, is stored in this ink container body 2. In the case of this embodiment, this ink container body 2 has the shape of a rectangular parallelepiped as shown in FIG. 1 or a shape close to this shape when the ink container body 2 is filled up with ink.

An ink supply opening 3 is provided on the bottom 2*a* side of the ink container body 2. This ink supply opening 3 is disposed in a position a little higher than a bottom 2*a* of the ink container body 2 and integrally fixed to the ink container body 2. The side of one opening end 3*a* (one end) of the ink supply opening 3 communicates with the inside of the ink container body 2 and the other opening end 3*b* (the other end) of the ink supply opening 3 is connected to the printing device side, the printing device being not shown in the figure.

A region for residual ink liquid 4 is provided on the bottom 2*a* side of the inside of the ink container body 2. This region for residual ink liquid 4, which is disposed in a position lower than one opening end 3*a* of the ink supply opening 3, is provided in order to positively store the residual ink liquid in the ink container body 2.

In this embodiment, in order to prevent the outflow of coarse-grained ink etc. from the region for residual ink liquid 4 to the ink supply opening 3, the construction is such that the lowest point P of the opening end 3*a* of the ink supply opening 3 coincides with a top surface 4*a* of the region for residual ink liquid 4.

Therefore, when the ink container 1 is placed on a horizontal surface, the liquid surface of the ink eventually remaining in the ink container body 2 becomes the lowest point P of the opening end 3*a* of the ink supply opening 3, and the ink standing in the region for residual ink liquid 4, which is a region lower than this lowest point P, will not flow out of this ink supply opening 3.

Shape retaining means 5 which keeps the shape and volume of the region for residual ink liquid 4 is provided on the bottom 2*a* side of the inside of the ink container body 2. Concretely, this shape retaining means 5 is formed from any of the sheet-entry preventing members 6 shown in FIGS. 2(*a*), 2(*b*) and 2(*c*).

All of the sheet-entry preventing members 6 in FIGS. 2(*a*), 2(*b*) and 2(*c*) have a shape similar to the region for residual ink liquid 4 and are formed in the shape of a hollow box the size of which is a little smaller than that of the region for residual ink liquid 4.

In the present invention, the construction adopted is such that a region in the shape of a rectangular parallelepiped flatter than the ink container body 2 is formed as the region for residual ink liquid 4. Therefore, the sheet-entry preventing member 6 is also in the shape of a rectangular parallelepiped flatter than the ink container body 2 to adapt to the shape of the region for residual ink liquid 4.

This sheet-entry preventing member 6 is disposed inside the region for residual ink liquid 4 in such a manner that the side of a top surface 6-1 thereof faces upward.

When ink in the ink container body 2 is taken out of the ink supply opening 3 by using negative pressure, the ink container body 2 contracts and the initial shape of the ink container body 2 is collapsed to contract. A sheet composing the top surface portion of the ink container body 2 (hereinafter referred to as the sheet composing the container top surface 2-1) becomes gradually drawn into the ink container body 2 with an increase in the volume of taken-out ink (ink consumption). When this drawn-in condition is viewed from the side of the region for residual ink liquid 4, the sheet composing the container top surface 2-1 gradually approaches the region for residual ink liquid 4 and is about to enter it. However, because the top surface portion 6-1 of the sheet-entry preventing member 6 is disposed beyond the place where the sheet composing the container top surface 2-1 is on the point of entering the region for residual ink liquid 4, the sheet composing the container top surface 2-1 does not enter the region for residual ink liquid 4. Therefore, the shape and volume of the region for residual ink liquid 4 are not changed by the entry of the sheet composing the container top surface 2-1 into the region for residual ink liquid 4, and the shape and volume of the region for residual ink liquid 4 are kept in the initial condition.

Like the sheet composing the container top surface 2-1, a sheet composing the side surface portion of the ink container body 2 (hereinafter referred to as the sheet composing the container side surface 2-2) also becomes gradually drawn into the ink container body 2 with an increase in the volume of taken-out ink in the ink container body 2 (the consumption of ink), and enters into the region for residual ink liquid. However, because the side surface portion 6-2 of the sheet-entry preventing member 6 is disposed beyond the place where the sheet composing the container side surface 2-2 is on the point of entering the region for residual ink liquid 4, the sheet composing the container side surface 2-2 does not enter the region for residual ink liquid 4. Therefore, the shape and volume of the region for residual ink liquid 4 are not changed by the entry of the sheet composing the container side surface 2-2 into the region for residual ink liquid 4, and the shape and volume of the region for residual ink liquid 4 are kept in the initial condition.

In short, the sheet-entry preventing member (shape retaining means) 6 in this embodiment prevents the sheet composing the ink container body 2 from entering the region for residual ink liquid 4 when this sheet moves, thereby keeping the shape and volume of the region for residual ink liquid 4 in the initial condition.

Multiple pores 7 are provided in an open condition in a top surface portion 6-1 of the sheet-entry preventing member 6. The pores have a size which enables at least coarse-grained ink etc. to pass through the pores. Therefore, coarse-grained ink present on the top surface portion 6-1 side of the sheet-entry preventing member 6 can precipitate and stand in the region for residual ink liquid 4 on the bottom 2*a* side of the ink container body by passing through the pores 7. The sectional shape of the pores 7 provided in an open condition in the top surface portion 6-1 of the sheet-entry preventing member 6 is an arbitrary one and various kinds of sectional shapes are conceivable.

FIG. 2(*a*) shows an example in which multiple pores 7 circular in cross section are provided in the top surface portion 6-1 of the sheet-entry preventing member 6. Although in this example, pores 7 circular in cross section are arranged in matrix condition, the arrangement of pores is not limited to this. Incidentally, in this example of FIG. 2(*a*), the areas where the pores 7 are not open in the whole top surface portion 6-1 of the sheet-entry preventing member 6 prevent the entry of the sheet composing the container top surface 2-1 into the region for residual ink liquid 4.

FIG. 2(*b*) shows an example in which multiple pores 7 quadrangular in cross section are provided in the top surface portion 6-1 of the sheet-entry preventing member 6. In this example, inside four quadrangles which are formed when the top surface portion 6-1 of the sheet-entry preventing member 6 is cut into quarters by cross lines, a pore 7 quadrangular in cross section and smaller in size than the quadrangles is arranged per quadrangle. However, the arrangement of pores is not limited to this. Incidentally, in this example of FIG. 2(*b*), the areas which correspond to the cross lines in the whole top surface portion 6-1 of the sheet-entry preventing member 6 prevent the entry of the sheet composing the container top surface 2-1 into the region for residual ink liquid 4.

FIG. 2(*c*) shows an example in which multiple pores 7 triangular in cross section are provided in the top surface portion 6-1 of the sheet-entry preventing member 6. In this example, inside four triangles which are formed when the top surface portion 6-1 of the sheet-entry preventing member 6 is divided by diagonal lines, a pore 7 quadrangular in cross section and smaller in size than the triangles is arranged per quadrangle. However, the arrangement of pores is not limited to this. Incidentally, in this example of FIG. 2(*c*), the areas which correspond to the diagonal lines in the whole top surface portion 6-1 of the sheet-entry preventing member 6 prevent the entry of the sheet composing the container top surface 2-1 into the region for residual ink liquid 4.

The pores 7 provided in the top surface portion of the sheet-entry preventing member 6, may form orifice (orifice pore), with its interior in the shape of an orifice, for example, as shown in FIG. 3(*a*) or FIG. 3(*b*).

FIG. 3(*a*) shows an example in which the whole interior of the pore 7 is formed in the shape of an orifice. That is, the pore 7 of FIG. 3(*a*) is such that the interior of the pore 7 narrows in funnel shape from the one end side of the pore 7 which enters coarse-grained ink (the pore top end) to the other end side of the pore 7 from which the coarse-grained ink is about to return in the reverse direction (the pore bottom end).

FIG. 3(*b*) shows an example in which the middle portion of the pore 7 is formed in the shape of an orifice. That is, the pore 7 of FIG. 3(*b*) is such that the interior of the pore narrows from the pore top end to near the middle portion in funnel shape, the inside diameter of the pore becomes a minimum near the middle portion and the interior of the pore becomes wide from near the middle portion to the pore bottom end.

When the interior of the pore 7 is formed in the shape of an orifice as described above, this provides the advantage that coarse-grained ink which passes through the pore 7 from above the sheet-entry preventing member 6 and stands in the region for residual ink liquid 4 cannot easily return again to above the sheet-entry preventing member 6.

Incidentally, it is also conceivable that when ink in the ink container body 2 is taken out of the ink supply opening 3, the ink flows to the ink supply opening 3 in the ink container body 2 and that the sheet-entry preventing member 6 moves due to this ink flow action etc., with the result that the shape retaining effect of the sheet-entry preventing member 6 which keeps the shape and volume of the region for residual ink liquid 4 may be impaired. For this reason, it is preferred that the sheet-entry preventing member 6 be fixed to the ink container body 2 side or to the ink supply opening 3 which is integral with the ink container body 2.

A material for the ink container body 2 is selected by paying attention to the following four items. Particularly when IJ ink is stored in the ink container body 2, the discharge of the ink from the head of an IJ printer may sometimes be greatly affected by the following items.

(1) The material itself or an added component of the material must have a small effect on the ink (protection of the ink which is the inner solution).

(2) The swelling, dimensional changes and strength changes of the ink container body by the ink must scarcely occur.

(3) Ink components must not seep through the ink container body (barrier characteristics of the inner solution).

(4) The volume of oxygen in the atmospheric oxygen which permeates the ink container body must be small (oxygen barrier characteristics).

Although a container formed from a single-layer or multilayer film material which is based on polyester (PET), polyamide (nylon) or polyolefilene (PE, PP) is preferable as a material which meets the conditions of the items (1) to (4) above, the material is not limited to them.

When an ink container body is formed from a multilayer film material, the oxygen and steam barrier characteristics of the ink container body can be more positively ensured by providing a film layer of aluminum, a deposited layer of aluminum or a deposited layer of silicon oxide (SiOx) between the layers of the multilayer film material.

It is needless to say that also for a material for the sheet-entry preventing member, the conditions of the items (1) and (2) above are met. Particularly, because the sheet-entry preventing member is means of keeping the shape and volume of the region for residual ink liquid, it is necessary that the sheet-entry preventing member be formed from a material having shape retaining properties.

Next, examples of use of the ink container body constructed as described above etc. will be described on the basis of FIG. 1.

The ink container 1 of FIG. 1 is used by being mounted on a printing device of, for example, a stencil printing device and an IJ printer. On this occasion, the other end 3*b* side of the ink supply opening 3 is connected to the printing device side. Ink in the ink container body 2 is taken out of the ink supply opening 3 and supplied to the printing head side in the printing device. Then, the ink container body 2 contracts according to the amount of taken-out ink and the volume thereof decreases. However, portions where a change in shape and a decrease in volume occur at this time are part of the ink container body 2, concretely, only portions except the region for residual ink liquid 4 on the bottom 2*a* side of the ink container body, and in the whole ink container body 2, the shape and volume of the region for residual ink liquid 4 which is present on the bottom side of the ink container body 2 are kept in the initial condition.

That is, although when ink is taken out of the inside of the ink container body 2, the sheet composing the container top surface 2-1 and the sheet composing the container side surface 2-2 become drawn into the ink container body 2 and are about to enter the region for residual ink liquid 4, this entry of the sheet into the region for residual ink liquid 4 is prevented by the sheet-entry preventing member 6. For this reason, even when ink is taken out of the inside of the ink container body 2, the shape and volume of the region for residual ink liquid 4 are kept in the initial condition.

In a case where coarse-grain ink etc. occur due to a change in the ink with time in the ink container body 2, the coarse-grained ink etc. pass through the pores 7 of the sheet-entry preventing member 6 and precipitate and stand in the region for residual ink liquid 4. On this occasion, even when contraction and deformation occur in the ink container body 2 by taking the ink out of the inside of the ink container body 2, the shape and volume of the region for residual ink liquid 4 are kept in the initial condition. Therefore, the coarse-grained ink etc. in the region for residual ink liquid 4 remain in the region for residual ink liquid 4 as they are, and the amount of coarse-grained ink etc. flowing out of the inside of the ink container body 2 into the printing device decreases greatly.

Therefore, troubles of clogging which are caused by the supply of precipitates of coarse-grained ink etc. to the inside of the printing device, remarkably decrease. The troubles are, for example, the clogging of the pores of the IJ head in the IJ printer and the clogging of the pores of the plate cylinder and screen in the stencil printing device. And the printing devices served with ink by these ink containers, get advantages of stable high-quality print image and stable operation with no clogging malfunction.

In the above-described embodiment, the construction adopted is such that a region in the shape of a rectangular parallelepiped flatter than the ink container body 2 is formed as the region for residual ink liquid 4. Therefore, the bottom surface of the region for residual ink liquid 4 is a flat horizontal surface without an inclination. In place of this construction, an inclined surface may be adopted as the bottom surface 4*a* of the region for residual ink liquid 4, as shown in FIG. 4.

In this case, the inclined surface is formed so as to be inclined toward the direction of the ink supply opening 3 and the lower portion side of the sheet-entry preventing member 6 is formed so as to be inclined to suit the inclination of the bottom surface 4*a* of the region for residual ink liquid.

In the case where as described above, the bottom surface 4*a* of the region for residual ink liquid 4 is formed as an inclined surface, the efficiency of causing coarse-grained ink to stand in the region for residual ink liquid 4 is more improved.

In the above-described embodiment, the construction adopted is such that as shown in FIG. 1, the whole of the bottom 2*a* side of the inside of the ink container body 2 is formed as the region for residual ink liquid 4. In place of this, only part of the bottom 2*a* side of the inside of the ink container body 2 may be formed as the region for residual ink liquid 4 as shown in FIG. 5.

In this case, although it is also possible to provide the region for residual ink liquid 4 in a position away from the ink supply opening 3, it is preferred that, as in the example of FIG. 5, the region for residual ink liquid 4 is disposed near, particularly in detail, below and on the border of the ink supply opening 3, in order to increase the efficiency of storing coarse-gained ink.

In the construction in which as described above, the region for residual ink liquid 4 is provided in part of the bottom 2*a* side of the ink container body 2, the ink is collected in one place of the bottom side of the ink container body 2 in a concentrated manner and remains there. Therefore, the ink remaining wastefully in the ink container body 2 decreases and hence the consumption rate of ink is improved.

Also in the construction in which as described above, part of the bottom 2*a* side of the ink container body 2 is formed as the region for residual ink liquid 4, an inclined surface may be adopted as the bottom surface 4*a* of the region for residual ink liquid 4, as shown in FIG. 6.

Also in this case, the lower portion side of the sheet-entry preventing member 6 is formed so as to be inclined to suit the inclination of the bottom surface 4*a* of the region for residual ink liquid. Incidentally, the detail construction of the inclined surface of the bottom surface 4*a* of the region for residual ink liquid is the same as the above-described inclined surface of FIG. 4 and hence a detailed description of the construction of this inclined surface is omitted.

Another embodiment of the sheet-entry preventing member 6 (shape retaining means), which is not illustrated, is a sheet-entry preventing member made, at its whole or its top surface, of a non-woven fabric having shape retaining properties.

When the sheet-entry preventing member 6 which uses a non-woven fabric as described above is adopted, it is expected that the coarse-grained ink becomes tangled among fibers composing the non-woven fabric and caught by them, so that coarse-grained ink is more effectively prevented from flowing out to the printing device side.

The ink container body described in the above embodiments is simply deformed in a flat shape and becomes collapsed when ink is taken out. As another example, the ink container body described in the Japanese Patent Laid-Open No. 2001-199455, may be adopted. This example of the ink container body has a flexible sheet which is reversed in a bent-back manner when ink is taken out.

DESCRIPTION OF SYMBOLS

Figure 1:
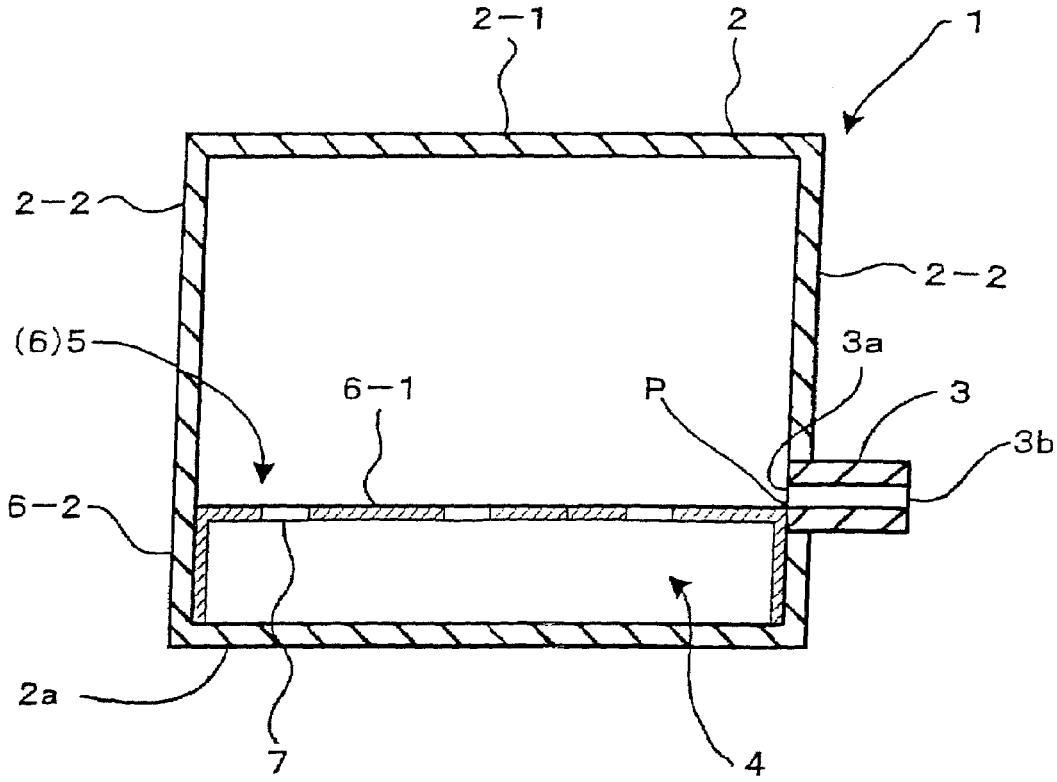
FIG. 1 is a sectional view of an ink container which is an embodiment of the present invention.
Figure 2:
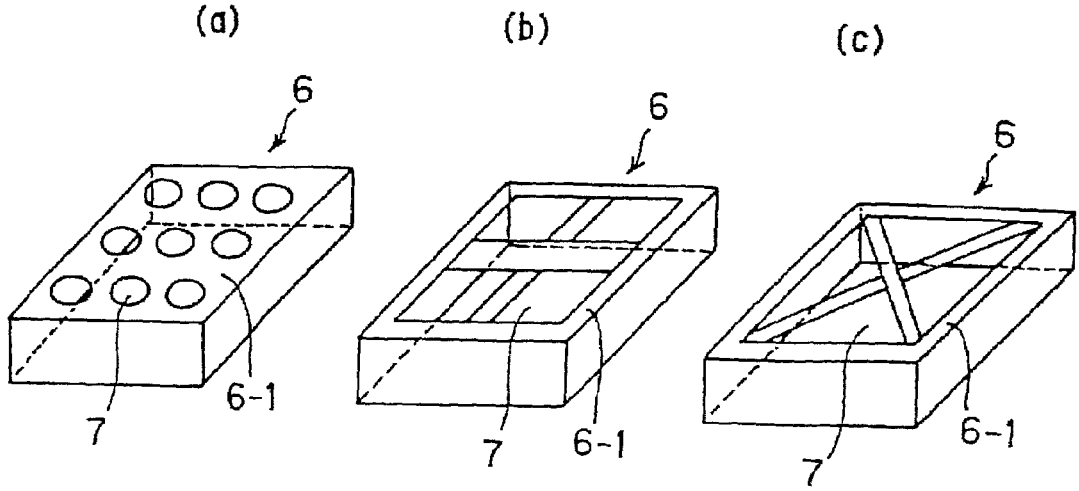
FIGS. 2(*a*), 2(*b*) and 2(*c*) are each perspective view of a sheet-entry preventing member adopted in the ink container of FIG. 1.
Figure 3:
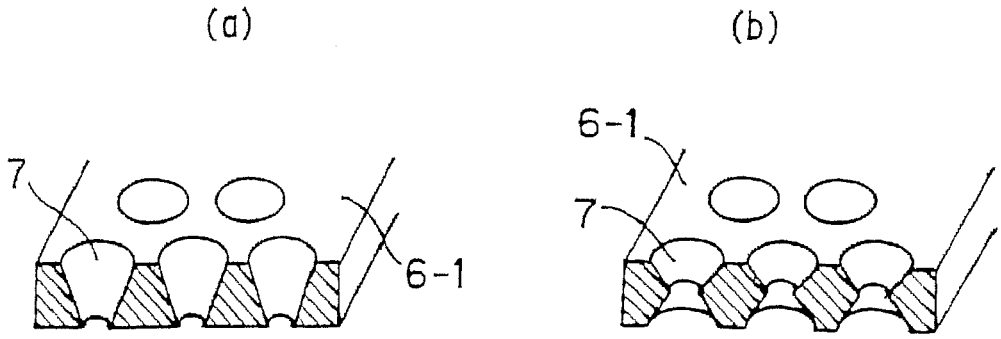
FIGS. 3(*a*) and 3(*b*) are each explanatory diagram of pores made in a sheet-entry preventing member.
Figure 4:
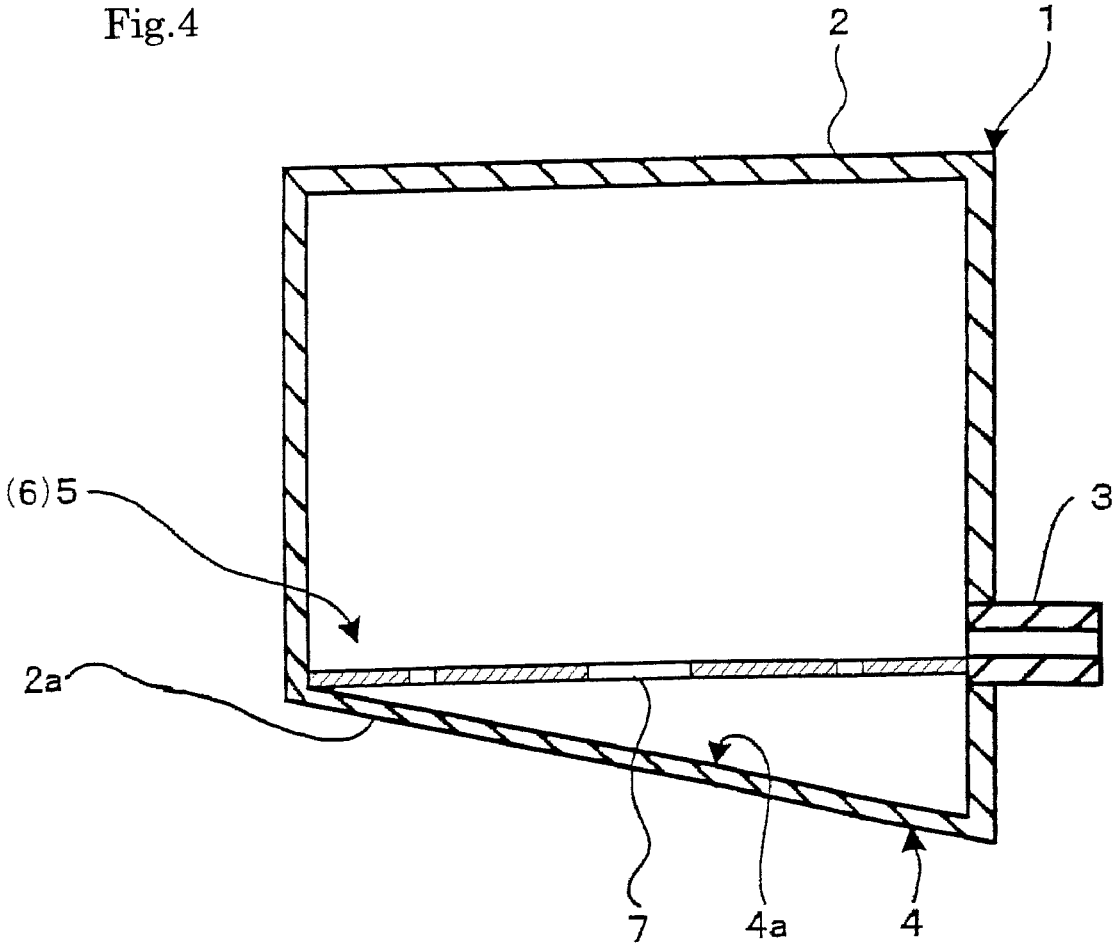
FIG. 4 is a sectional view of an ink container which is another embodiment of the present invention.
Figure 5:
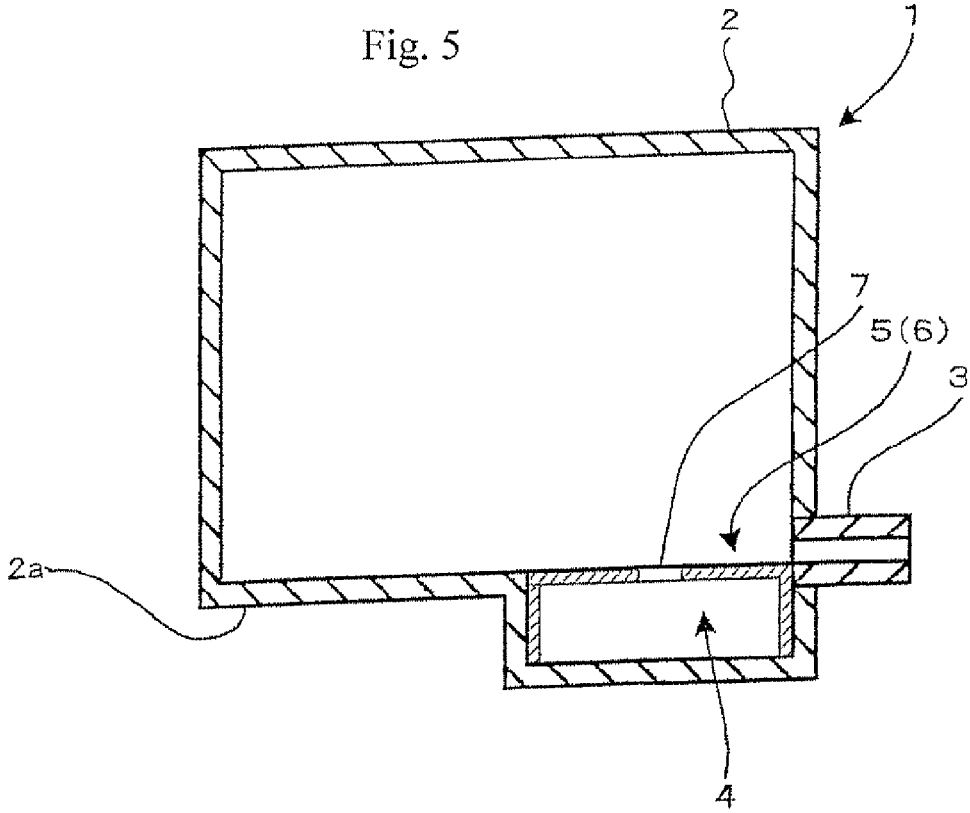
FIG. 5 is a sectional view of an ink container which is another embodiment of the present invention.
Figure 6:
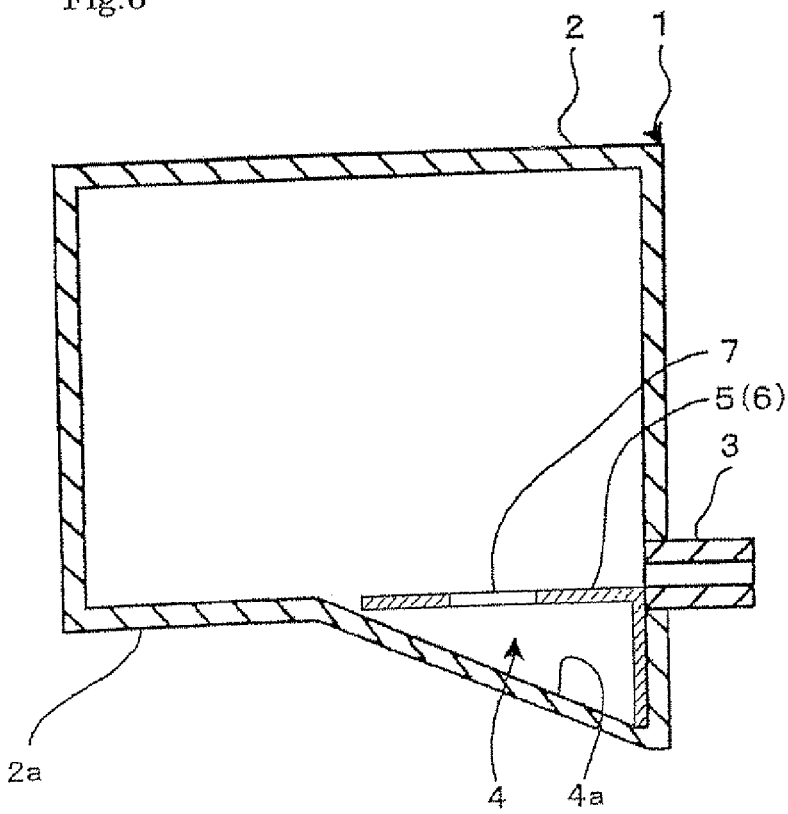
FIG. 6 is a sectional view of an ink container which is another embodiment of the present invention.

1 Ink container
2 Ink container body
2-1 Sheet composing the container top surface
2-2 Sheet composing the container side surface
2*a* Bottom of ink container body
3 Ink supply opening [part]

3*a* One opening end of ink supply opening (one end)
3*b* The other opening end of ink supply opening(the other end)
4 Region for residual ink liquid
4*a* Bottom surface of region for residual ink liquid
5 Shape retaining means
6 Sheet-entry preventing member
6-1 Top surface part of sheet-entry preventing member
7 Pore

The invention claimed is;

1. An ink container mounted on a printing device comprising a bag-shaped ink container body formed from a flexible sheet, an ink supply opening having a first and a second end, the first end communicates with the inside of the ink container body and the second end being connected to the printing device, and the bag-shaped ink container body is provided with a region for residual ink liquid, the region being disposed at the bottom, lower than the communicating end of the ink supply opening, and with shape retaining means for keeping the shape and volume of the region for residual ink liquid, wherein the shape retaining means is provided by a sheet-entry preventing member formed in the shape of an orifice pore and the direction of the orifice pore is arranged away from the ink supply opening.

2. The ink container according to claim 1, wherein the region for residual ink liquid consists of a part of the bottom portion of the ink container body and is disposed below and on the border of the ink supply opening.

3. The ink container according to claim 1, wherein the region for residual ink liquid is disposed in such a manner that a top surface thereof coincides with the lowest point of the communicating end of the ink supply opening.

4. The ink container according to claim 1, wherein the shape retaining means keeps the shape and volume of the region for residual ink liquid by preventing the sheet of the ink container body from entering into the region for residual ink liquid when the sheet moves.

5. The ink container according to claim 1, wherein the shape retaining means is fixed to either or both of the ink container body and the ink supply opening.

6. The ink container according to claim 1, wherein the shape retaining means is a sheet-entry preventing member having an orifice pore or a plurality of orifice pores on the top surface thereof, the pore being allowable of coarse-grained ink through-passing.

7. The ink container according to claim 1, wherein the shape retaining means is formed from a non-woven fabric.

* * * * *